US007959096B1

(12) United States Patent
Wells, Sr.

(10) Patent No.: US 7,959,096 B1
(45) Date of Patent: Jun. 14, 2011

(54) WELLS PRESCRIPTION LABEL SHREDDER

(76) Inventor: Tommy Edward Wells, Sr., Stafford, TX (US)

( * ) Notice: Subject to any disclaimer, the term of this patent is extended or adjusted under 35 U.S.C. 154(b) by 9 days.

(21) Appl. No.: 12/384,817

(22) Filed: Apr. 9, 2009

Related U.S. Application Data

(60) Provisional application No. 61/123,657, filed on Apr. 11, 2008.

(51) Int. Cl.
*B02C 19/00* (2006.01)

(52) U.S. Cl. ..... 241/14; 241/100; 241/99; 241/606

(58) Field of Classification Search ..... 241/99, 241/14, 100, 606; 156/344, 584, 153, 154; 15/63, 88.3
See application file for complete search history.

(56) References Cited

U.S. PATENT DOCUMENTS 4,013,497 A * 3/1977 Wolf ..... 156/154
4,944,832 A * 7/1990 Abe et al. ..... 156/584
5,718,030 A * 2/1998 Langmack et al. ..... 29/426.3

* cited by examiner

*Primary Examiner* — Mark Rosenbaum

(57) ABSTRACT

As previously disclosed this invention will change a lot of ways the prescription bottle is used, such as Americans won't have to keep them for lack of time to destroy them. The shredder will prevent a lot of injuries from people trying to scrap information off the bottle with a sharp object. It would be made of parts right here in the United States and of communally used parts. The invention will be child proof but most of all the cost to build would be minimal so it would be very affordable for the majority of Americans.

1 Claim, 7 Drawing Sheets

WELLS PRESCRIPTION LABEL SHREDDER

CROSS-REFERENCE TO RELATED APPLICATIONS

Application No. 61/123,657
Filing Date Apr. 11, 2008

STATEMENT REGARDING FEDERALLY SPONSORED RESEARCH OR DEVELOPMENT

Not Applicable

DESCRIPTION

1. Field of Invention

This invention relates to a label shredder for prescription bottles designed to destroy pertinent personal information that is on the label without destroying the bottle prior to consumer disposing of bottles.

2. Background

In a world where identity theft and computer technology are growing rapidly, the need to protect ones self is pertinent. With the abundant use of pharmaceutical drugs the probability of identity theft from labels is rising.

In general, people will store, bag up or attempt to scratch off the label which can be dangerous, especially for elderly Americans. For the lack of an alternate way to eliminate their personal information a shredder of this magnitude is greatly needed.

SUMMARY OF INVENTION

The propose of this invention is to give prescription users a more efficient and safer way to destroy personal and medical information.

By simply placing your empty medicine bottle in the machine all private information will be destroyed, without destroying the bottle.

DESCRIPTION OF DRAWINGS REFERENCE NUMERALS

| | |
|---|---|
| 10 | Motor |
| 12 | Mounting Brackets 1 |
| 14 | Mounting Brackets 2 |
| 16 | Shredding Blade |
| 18 | Fly Wheel |
| 20 | Plastic Gears 1 |
| 22 | Plastic Gears 2 |
| 24 | Motor Gear |
| 26 | Bracing Roller 1 |
| 28 | Bracing Roller 2 |
| 30 | Micro Switch |
| 32 | Adjustable Blade Lever |
| 34 | Roller Mounting Bracket |
| 36 | Top or Lid |
| 38 | Locking Clips 1 |
| 40 | Locking Clips 2 |
| 42 | Locking Clips 3 |
| 44 | Din Jack Power |
| 46 | Slot Locking Peg |
| 48 | Plastic Molded Inserts |
| 50 | Two Slot Locking Holder |
| 52 | A Plastic Waste Tray |

BRIEF DESCRIPTION OF DRAWINGS

These and other modifications and advantages will become more apparent from the following detailed description of the preferred embodiment of the invention and from the drawings in which.

DETAILED DESCRIPTION OF INVENTION

Preferred Embodiment

Figure 1:
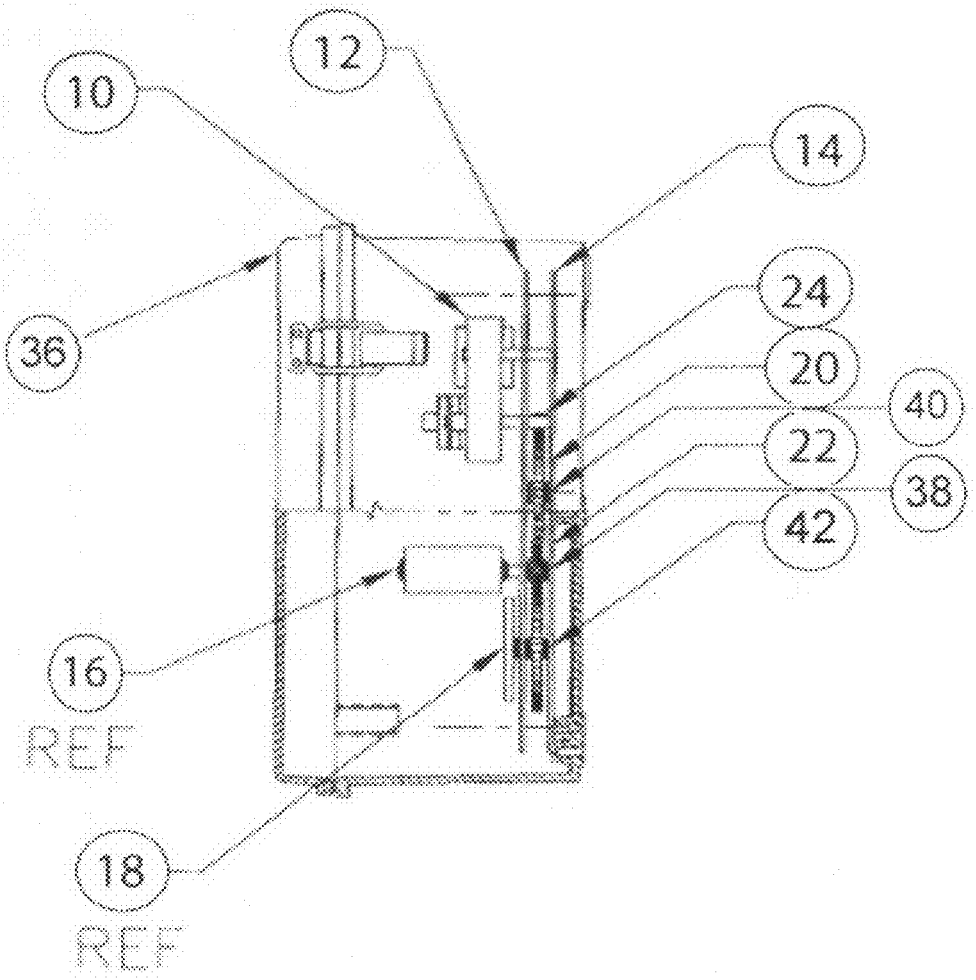
FIG. 1 Is the enclosure showing all of the working parts of the Assembly.
Figure 2:
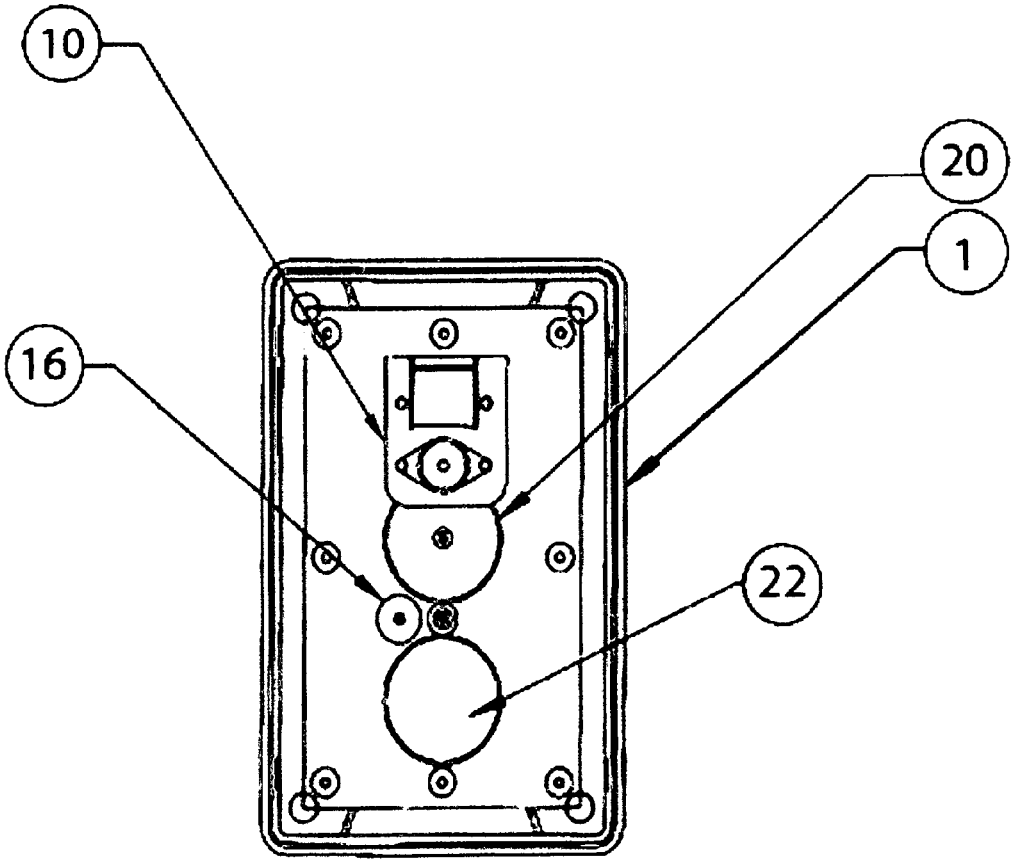
FIG. 2 Is the top view of enclosure and working parts.
Figure 3:
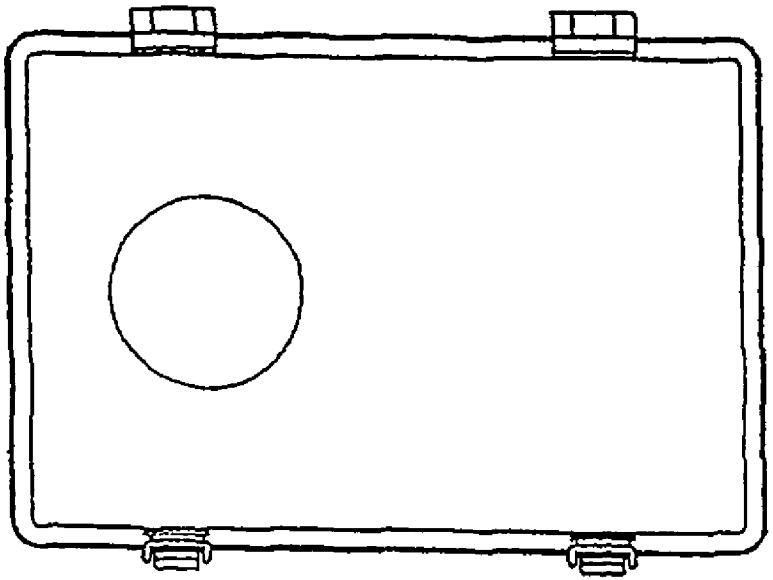
FIG. 3 Is the top view of enclosure showing prescription container inserting hole.
Figure 4:
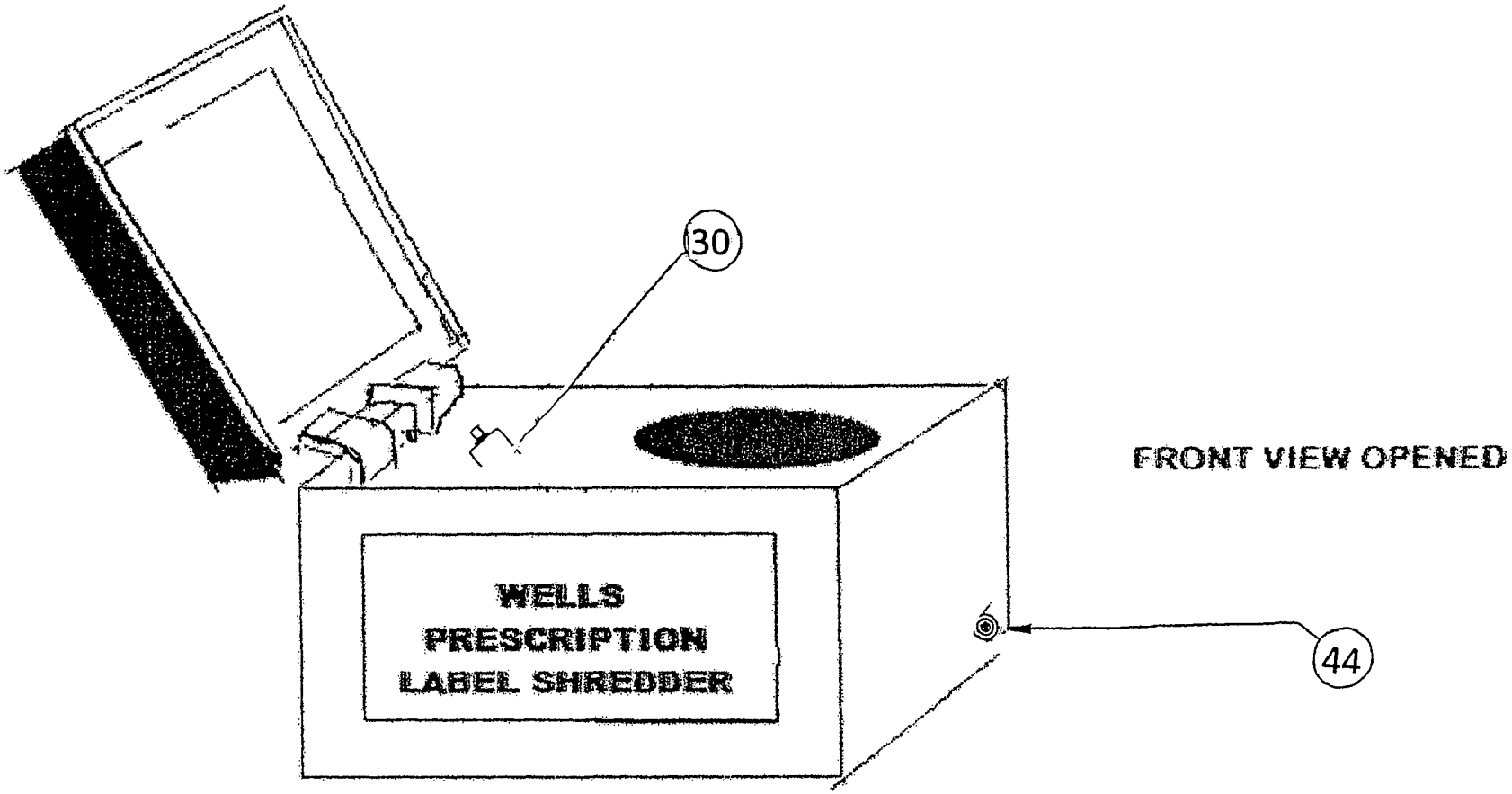
FIG. 4 Is a full front and side view of enclosure showing micro switch the top and din jack plug.
Figure 5:
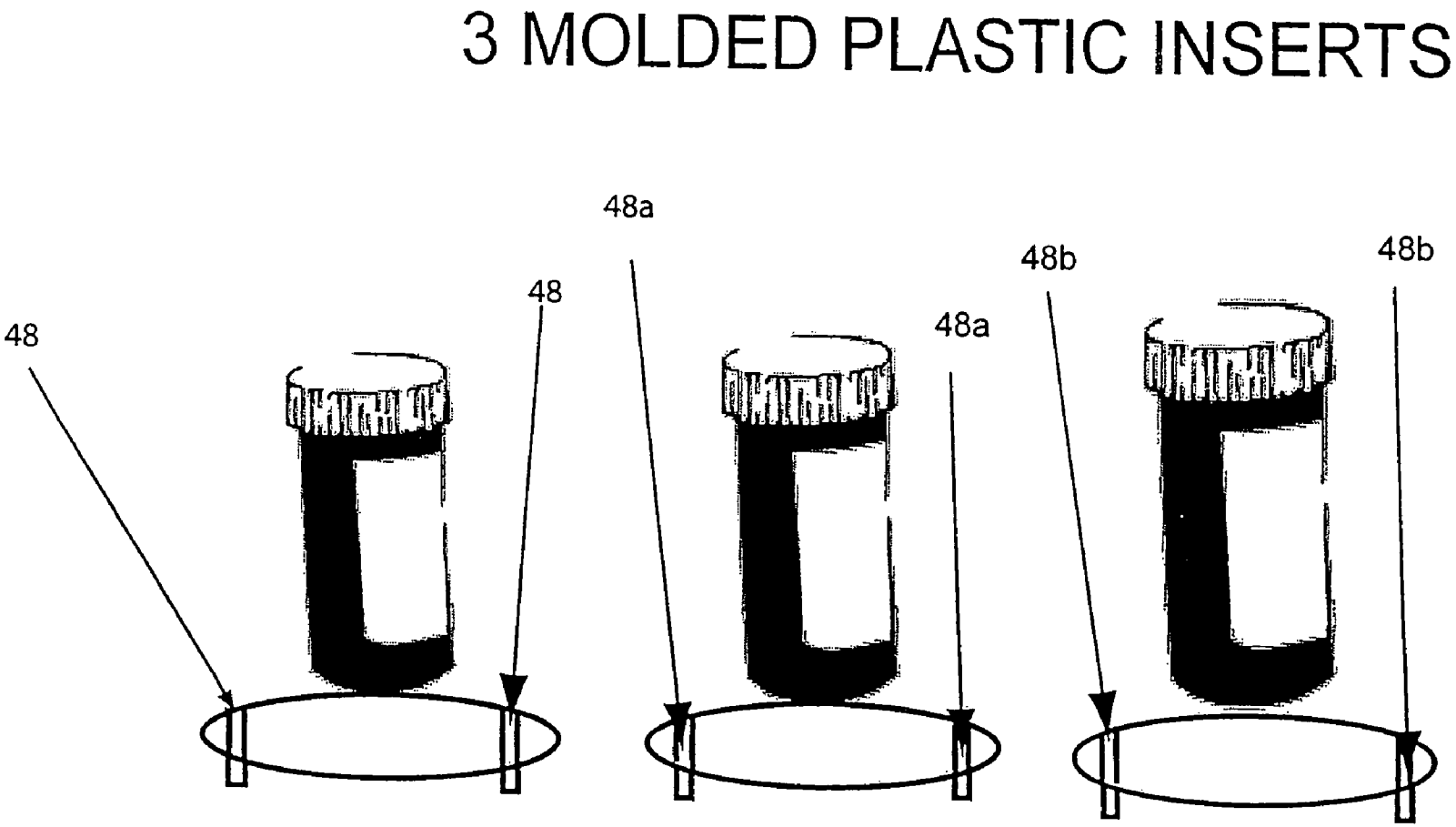
FIG. 5 Shows the plastic molded inserts.
Figure 6:
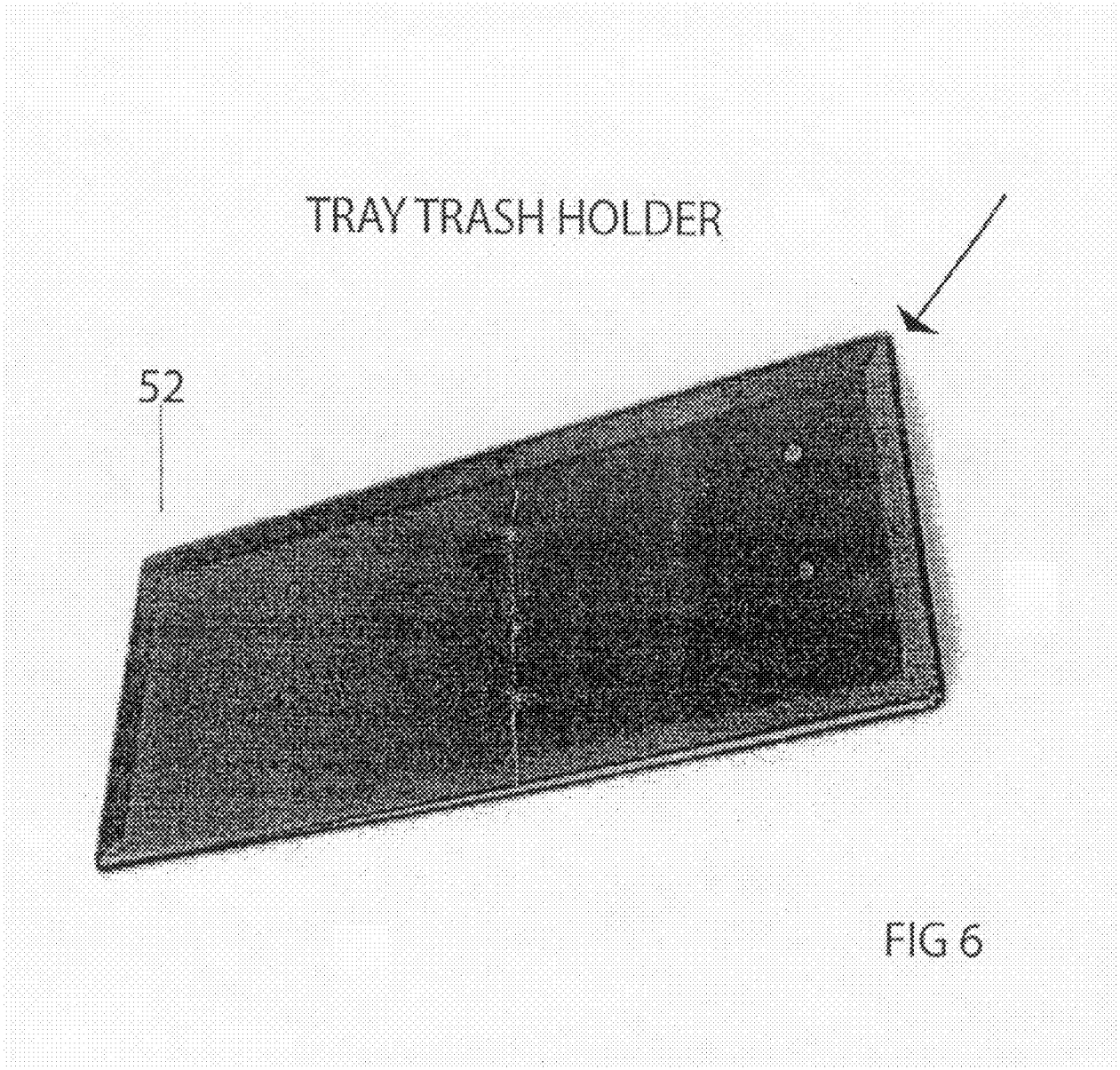
FIG. 6 Shows the waste tray.
Figure 7:
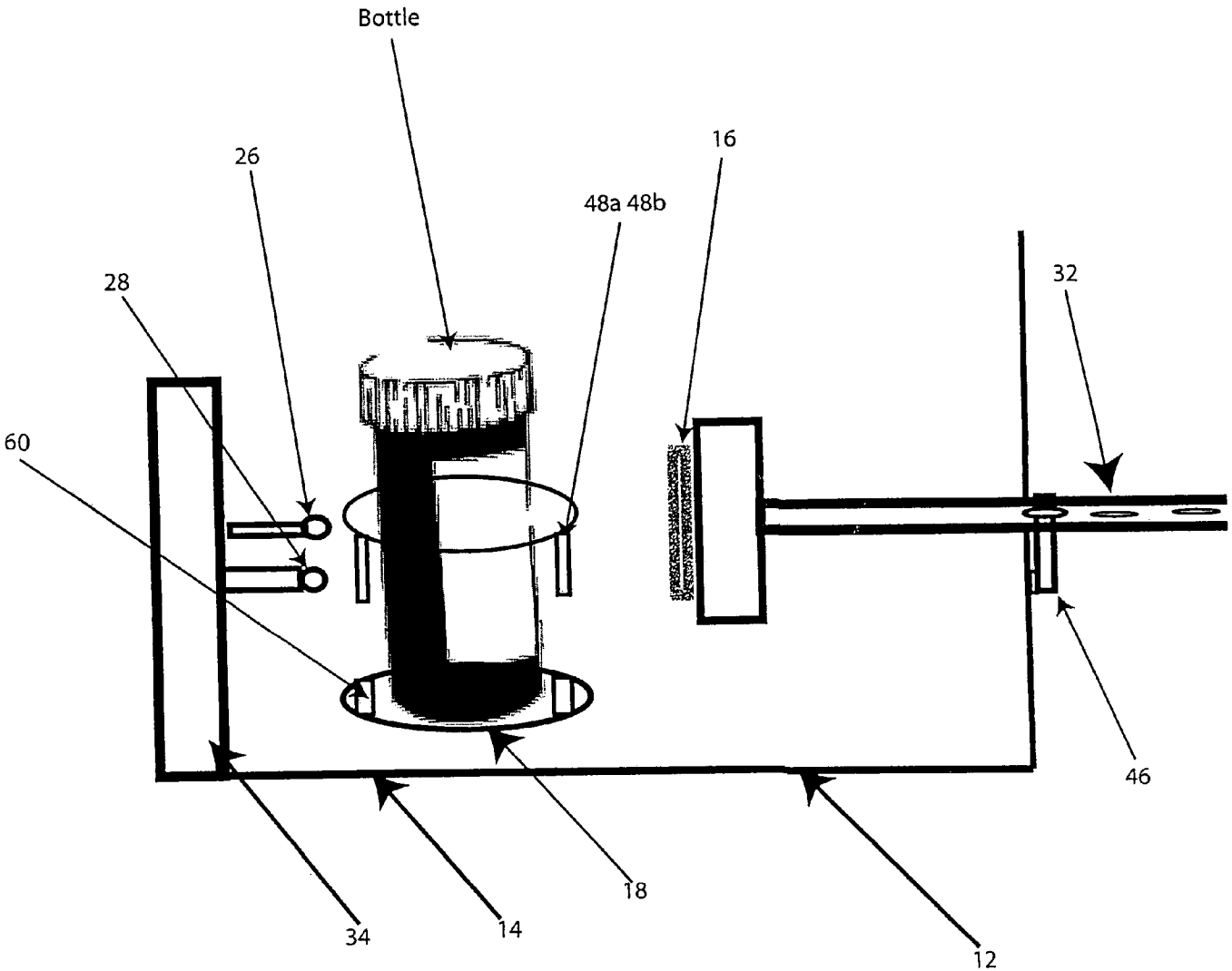
FIG. 7 Shows stabilizing roller, roller mounting bracket, plastic inserts, prescription bottle, blade, fly wheel, adjustable lever, slot locking holder on fly wheel, slot locking peg.

Referring first to FIG. 1 the enclosure which is showing each part of the whole assembly. This includes a motor (10) that will operate the gear assembly. Mounting plates (12) and (14) that will hold the gear assembly, the stablelizing bracket (34) and bracing rollers (26) and (28) and also the shredding blade (16) that will shred the personal information off the prescription container. The gears (20) and (22) will interconnect to turn the fly wheel (18) which is mounted on top of gear (22) which is were the prescription container will sit while being shredded. The motor gear (24) will interconnect and turn plastic gears (20) and (22), these gears may vary in size to get the correct operating speed. The two stablelizing rollers (26) and (28) will also turn freely for more of a smoother shredding action. A micro switch (30) will be mounted just below the top (36) or lid (36) in FIG. 4 this micro switch (30) will only operate the device when lid or top (36) is closed. This should be considered as a child safety precaution as like any new device should have. An adjustable lever (32) will slide and lock the blade (16) against the various size prescriptions containers on one slot locking peg (46) located on the enclosure FIG. 1). There will be a two slot locking holder (50) made on the fly wheel (18) that will hold the various size plastic inserts (48) shown in FIG. 5. There will be locking clips (38) (40) and (42) shown in FIG. 1 to hold gear assembly, shredder blade (16) together. In FIG. 4 shows plug in din jack (44) for power source which may vary from a 15 to 24 (vdc) power adaptor to an optional (120vac) power plug to obtain the correct speed. There will be a waste tray (52) shown in FIG. 6 to catch shredded paper.

Ramifications

The Wells Prescription Label Shredder Invention will be an economical yet very reliable, decodable device. The present invention could be used by a person at the age of ten but would be marketed to Americans eighteen and up but specifically to elderly Americans. The description of this invention contains an embodiment for electrical operation. The scopes of the specifications shown in the drawing supplied are not limited to this particular or preferred embodiment. There are other variations of present invention; such as a manual version in which you push the prescription bottle in a cylinder down on blades and information is destroyed and let's not forget a battery option version and also an ink black out version. In the future a more sophisticated slide gear operated all automatic version will be introduced. In the future these bottles could be bought back from consumer to be recycled and reused creating a need for a recycling plant which in turn would create jobs in a new industry. It would create the purchase of assembly parts and certain materials to build package and ship this new invention. Until total development of this device, a variation of parts, diameter and size of gears, gear motors and assembly parts will vary.

What is claimed is:

1. A method for destroying and eliminating all personal and medical information displayed on various size prescription containers having labels, comprising:

a) placing a prescription container in an enclosure so it can be turned on a flywheel;

b) locating molded inserts with pegs on either side of said container;

c) locking in inserts in slots on the flywheel to enable the rotating process of said container;

d) pressing said container against two free wheeling rollers;

e) locking a blade against said container with an adjustable lever;

f) closing a lid on said enclosure to activate a micro-switch located in said enclosure;

g) using said blade to eliminate information by destroying the label of said container;

h) rotating said flywheel with a gear motor and plastic gears;

i) stopping operation of the blade and flywheel when the label has been destroyed and dropped into a waste tray located in said enclosure;

j) removing said waste tray from the enclosure along with the destroyed label.

* * * * *